US012434886B2

(12) United States Patent
Parnes

(10) Patent No.: US 12,434,886 B2
(45) Date of Patent: Oct. 7, 2025

(54) SECURELY-ATTACHING REMOVABLE LID FOR CUP

(71) Applicant: Jason Michael Parnes, Mount Vernon, NY (US)

(72) Inventor: Jason Michael Parnes, Mount Vernon, NY (US)

( * ) Notice: Subject to any disclaimer, the term of this patent is extended or adjusted under 35 U.S.C. 154(b) by 1091 days.

(21) Appl. No.: 16/805,650

(22) Filed: Feb. 28, 2020

(65) Prior Publication Data

US 2020/0307869 A1 Oct. 1, 2020

Related U.S. Application Data

(60) Provisional application No. 62/875,939, filed on Jul. 18, 2019, provisional application No. 62/811,706, filed on Feb. 28, 2019.

(51) Int. Cl.
*B65D 43/02* (2006.01)

(52) U.S. Cl.
CPC ..... *B65D 43/0208* (2013.01); *B65D 2543/00092* (2013.01); *B65D 2543/00351* (2013.01); *B65D 2543/00518* (2013.01); *B65D 2543/00537* (2013.01); *B65D 2543/00555* (2013.01); *B65D 2543/00629* (2013.01); *B65D 2543/00685* (2013.01)

(58) Field of Classification Search
CPC ..... B65D 43/0208; B65D 2543/00518; B65D 2543/00537
See application file for complete search history.

(56) References Cited

U.S. PATENT DOCUMENTS 4,376,493 A * 3/1983 Gall ..... B65D 45/20 220/784

* cited by examiner

*Primary Examiner* — Jeffrey R Allen
(74) *Attorney, Agent, or Firm* — Integral Patent; Laurence J. Shaw

(57) ABSTRACT

A lid for secure engagement with a disposable plastic cup to prevent spilling and allow for vigorous mixing of enclosed contents. The lid includes a guidance skirt, an orientation securing layer, and a secure engagement layer. The guidance skirt provides guidance of the rim of the cup into the orientation securing layer. The orientation securing layer helps stabilize the orientation of the lid during transition into the secure engagement layer. Furthermore, the lid has good flight characteristics when tossed as a flying disk because the profile of its cross-section roughly approximates the shape of an airfoil, and multiple substantially vertical portions near the perimeter of the lid augment the moment of inertia.

11 Claims, 10 Drawing Sheets

FIG. 4 -- Table 1

| Lid type | Young's modulus E (dynes/cm^2) | Size of cup (grams) | Overhang distance δ (cm) | Thickness d (cm) | Top circumfer-ence C (cm) | Length to overhang L (cm) | Tightness-of-fit ratio Ψ | Edge force to pivot off lid (in grams * g) | Tightness-of-fit multiple φ |
|---|---|---|---|---|---|---|---|---|---|
| Present invention | 2E+12 | 510 | 0.07 | 0.030 | 31 | 0.33 | 1631.0 | 1800 | 3.5 |
| McDonalds coffee - Small | 1.75E+12 | 453 | 0.09 | 0.015 | 28 | 0.45 | 92.0 | 1200 | 2.6 |
| McDonalds coffee - Medium | 1.75E+12 | 595 | 0.09 | 0.015 | 28 | 0.45 | 70.0 | 1200 | 2.0 |
| McDonalds coffee - Large | 1.75E+12 | 850 | 0.09 | 0.015 | 28 | 0.45 | 49.0 | 1200 | 1.4 |
| Starbucks - 16 oz | 1.75E+12 | 453 | 0.08 | 0.030 | 30.5 | 0.36 | 1391.6 | 450 | 1.0 |

SECURELY-ATTACHING REMOVABLE LID FOR CUP

RELATED APPLICATIONS

The present application is based on and claims priority to provisional patent application Ser. No. 62/811,706 for "Cup lid" by Jason Michael Parnes filed Feb. 28, 2019, and is based on and claims priority to provisional patent application Ser. No. 62/875,939 for "Securely-attaching removable lid for plastic cup" by Jason Michael Parnes filed Jul. 18, 2019. These provisional patent applications are incorporated herein by reference.

FIELD OF THE INVENTION

The present invention is related to food and beverage wares, more particularly to cups and lids, and possibly still more particularly to disposable cups and lids.

BACKGROUND OF THE INVENTION

As noted in provisional patent application Ser. No. 62/811,706 for "Cup lid" filed by Jason Michael Parnes on Feb. 28, 2019, which is hereby incorporated herein by reference, numerous types of cup lids have been proposed, developed and marketed. However, they have all been designed so as to confine the liquid within the cup when the cup is upright and transported relatively carefully. None of them provide an attachment of the lid to the cup which is secure enough that the engaged ensemble is reliably spill proof when overturned, and/or when the carrier of the cup is bumped or jostled, such as in a crowded bar, sports event, or concert, and/or when the sealed cup is used as a shaker for mixing of liquids, ice cubes, powders, berries, fruits or fruit sections, etc. contained within the ensemble, especially when vigorous shaking is required. Furthermore, none of them provide an intermediate engagement configuration, or a means for applying a large sealing force while insuring the lid and cup will not be damaged, or are adapted to also function as a flying disk.

It is therefore an object of the present invention to provide a removably-attachable lid for a cup which attaches securely.

It is another object of the present invention to provide a removably-attachable lid for a disposable plastic (or similar material) cup which attaches securely.

More particularly, it is an object of the present invention to provide a removably-attachable lid for a disposable cup which attaches securely enough to remain attached during circumstances such as tipping over, dropping, agitation (including vigorous agitation), etc. to mix inside contents, where the inside contents may be liquids, ice cubes, powders, etc.

Furthermore, it is an object of the present invention to provide a securely-attaching removable lid for a cup which is easily navigated to the attachment position.

It is another object of the present invention to provide a removable, securely-attachable lid for a cup where attachment involves a two-stage engagement process.

It is another object of the present invention to provide a removable, securely-attachable lid for a cup which includes an integrally-formed means for facilitating the navigation to a secure attachment stage.

It is another object of the present invention to provide a removable, securely-attachable lid which is relatively easy to secure to and purposefully dislodge from a cup, while at the same time requiring a relatively large agitation- or tipping-induced force to dislodge the lid from the cup. It is another object of the present invention to provide a removable, securely-attachable lid for a disposable plastic cup which may be secured to and removed from a cup a number of times.

More particularly, it is another object of the present invention to provide a removable, securely-attachable lid for a disposable plastic cup which includes an integrally-formed means for facilitating the application of force to transition from an initial engagement stage to a secure attachment stage while insuring the lid and cup will not be damaged in the process.

It is another object of the present invention to provide a removably-attachable lid for a disposable plastic cup which can be tossed like a flying disk.

Additional objects and advantages of the invention will be set forth in the description which follows and/or will be apparent from the description and/or may be learned by practice of the invention.

SUMMARY OF THE INVENTION

A lid for secure engagement with a cup to prevent spilling and allow for vigorous mixing of enclosed contents. The lid includes a guidance skirt, an orientation securing layer, a secure engagement layer, and a force limiting wing. The guidance skirt provides guidance of the rim of the cup into the orientation securing layer. The orientation securing layer helps stabilize the orientation of the lid during transition into the secure engagement layer. The cup rim may be navigated into the secure engagement layer of the lid by pressing down on the force limiting wing with a force which will flip portions of the force limiting wing into a downwards slanting orientation. The force required to flip portions of the force limiting wing into the downwards slanting orientation is less than forces which would cause crumpling of the cup and other portions of the lid.

Furthermore, the lid has good flight characteristics when tossed as a flying disk because the profile of its cross-section roughly approximates the shape of an airfoil, and multiple substantially vertical portions near the perimeter of the lid augment the moment of inertia.

BRIEF DESCRIPTION OF THE DRAWINGS

The accompanying figures, which are incorporated in and form a part of this specification, illustrate embodiments of the invention and, together with the description given above and the detailed description of the preferred embodiments given below, serve to explain the principles of the invention.

FIG. 4 provides Table 1, a table showing the dimensionless tightness-of-fit multiple φ, and the dimensionless tightness-of-fit ratio Ψ as well as the values of the variables used to generate the dimensionless tightness-of-fit ratio Ψ for the cup lid of the present invention and a number of common disposable cup lids.

DETAILED DESCRIPTION OF THE PREFERRED EMBODIMENTS

Figure 1:
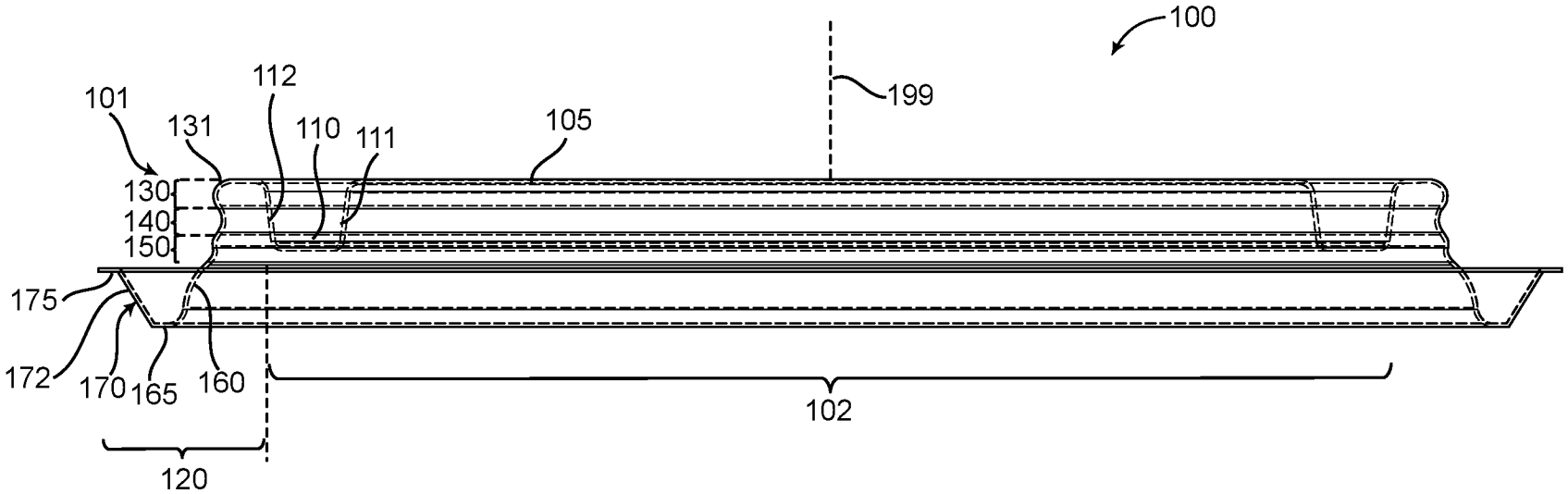
FIG. 1 shows a cross-sectional view of a securely-attaching removable lid according to the present invention.

Shown in FIG. 1 is a cross-sectional view of a removable, securely-attaching lid for a cup (and more particularly a disposable plastic cup) according to a first embodiment of the present invention. The lid (100) has cylindrical symmetry about a central axis (199). The lid (100) has a central portion (102) and a rim portion (120). The central portion (102) includes a raised middle portion (105), and a trough (110) around the circumference of the raised middle portion (105) and hence between the raised middle portion (105) and the rim portion (120). The rim portion (120) includes a secure engagement layer (130), a transition overhang layer (140), an orientation securing layer (150), a guidance skirt (160), a horizontal bottom flange (165), and a manual engagement wing (170). The engagement wing (170) includes an upwards slanting portion (172) and a horizontal outer flange (175).

Figure 2B:
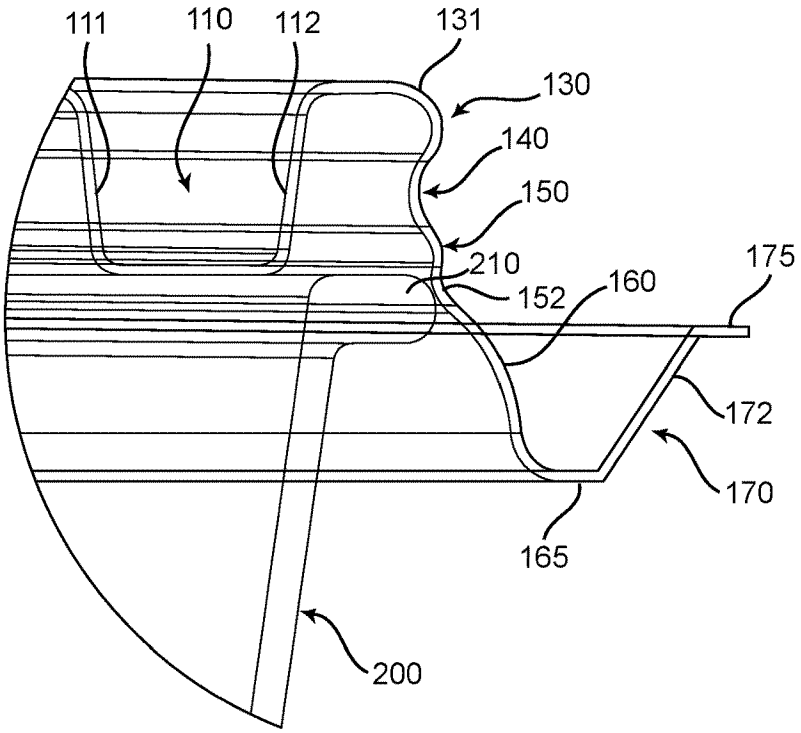
FIG. 2B is a magnified cross-sectional view showing the rim of the cup at the top of the guidance skirt of the lid of FIG. 1.
Figure 2A:
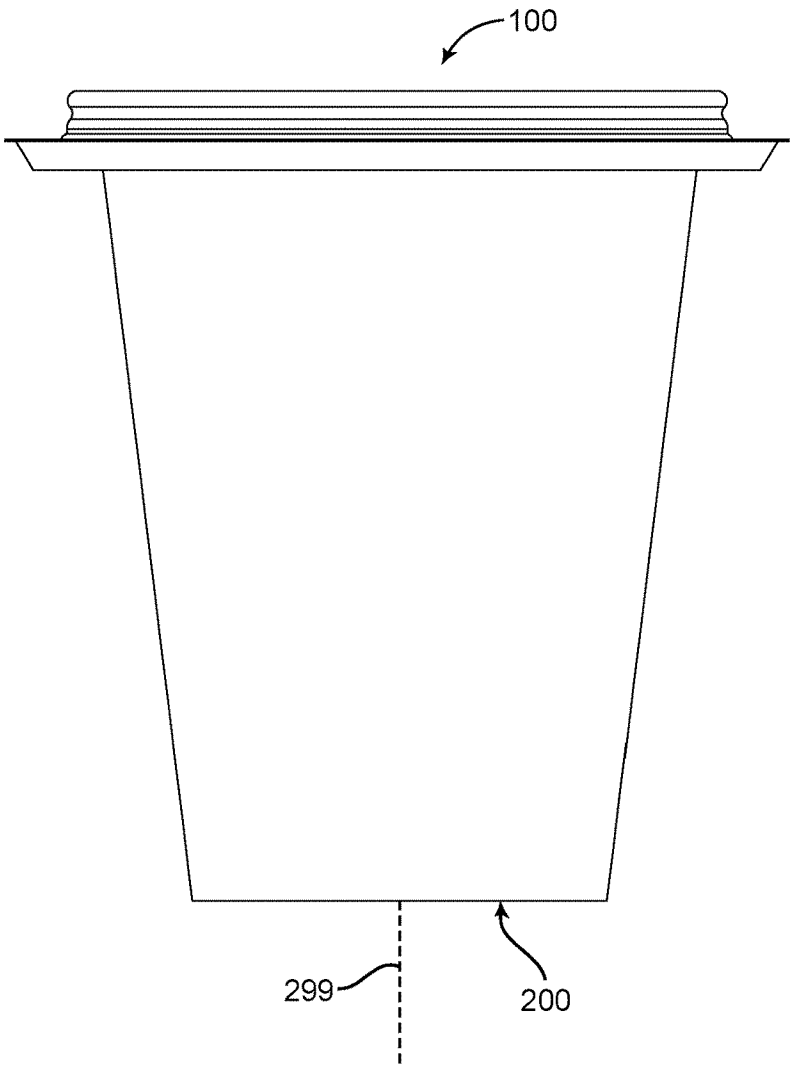
FIG. 2A shows the securely-attaching removable lid of the present invention engaged on a cup.

The lid (100) of the present invention may be engaged securely with a cup (200) through the series of steps shown in FIGS. 2B, 2C, 2D, 5A, and 5B. To initiate engagement of the lid (100) with the cup (200), initially the lid (100) is lowered onto the cup (200) and the cup rim (210) makes contact with the guidance skirt (160), as is shown in FIG. 2B. The inside contour of the guidance skirt (160) is concave with a narrowing side-to-side diameter with height. Therefore, the guidance skirt (160) guides the user in centering the lid (100) on the cup (200) so the lid (100) is easily positioned on the cup (200). In particular, the guidance skirt (160) guides the user in aligning the axis of cylindrical symmetry (299) of the cup (200) and the axis of cylindrical symmetry (199) of the lid (100).

Figure 2C:
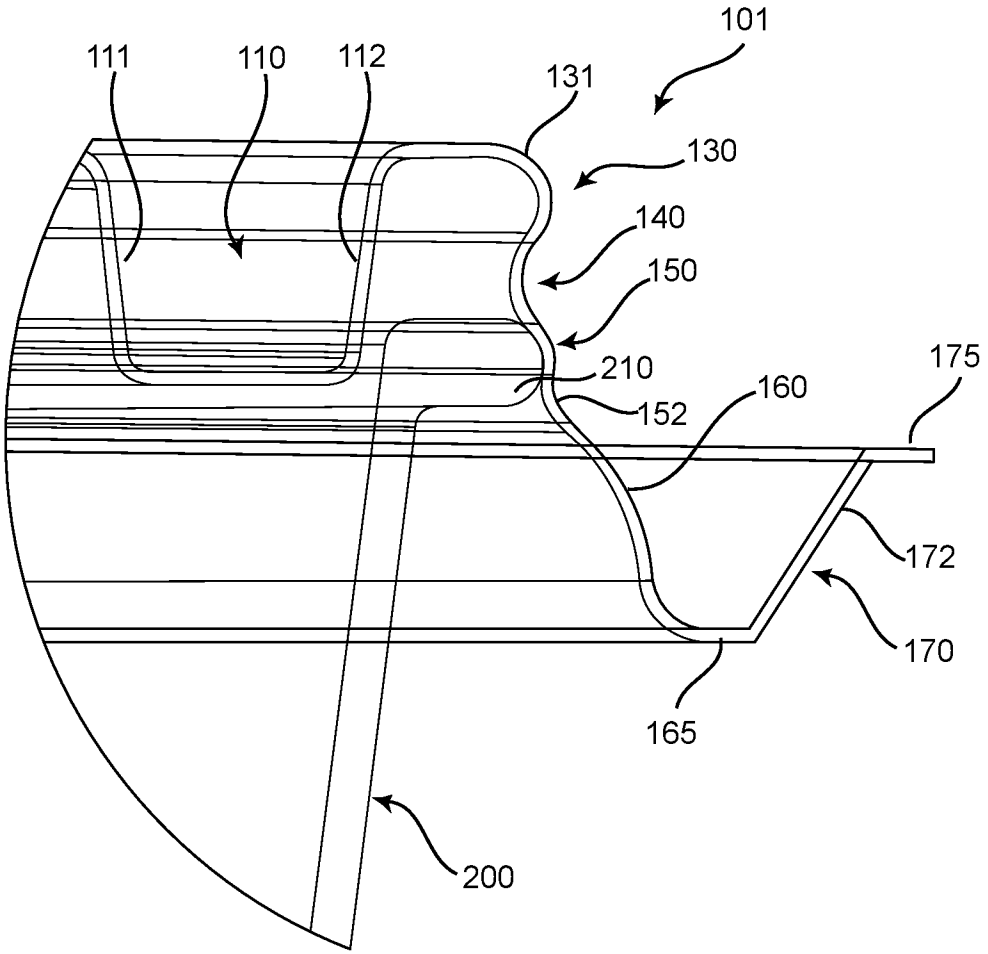
FIG. 2C is a magnified cross-sectional view showing the engagement of the rim of the cup in the orientation securing layer of the lid of FIG. 1.

The downwards motion of the lid (100) is initially resisted by the narrowing of the side-to-side diameter of the lid (100) which occurs in the region between the top of the guidance skirt (160) and the bottom of the orientation securing layer (150). The lid (100) is made of Pentafood® Rigid APET FD-E630F01 manufactured by Klöckner Pentaplast of Heiligenroth, Germany. The dimensions of the lid (100) and the material properties of the material used for the lid (100) are such that with a downwards force $F_O$ applied uniformly across the top outer edge of the lid (100), the portion of the lid (100) outwards from the top outside corner (131) of the secure engagement layer (130) temporarily flexes/pivots outwards to allow the cup rim (210) to be transitioned to engagement in the orientation securing layer (150), as is shown in FIG. 2C. As can be seen from FIG. 2C, the outer edge of the cup rim (210) fits snugly in the inner contour of the orientation securing layer (150) with the inside surface of the cup rim (210) abutting the inner inside surface of the orientation securing layer (150). The narrowing of the side-to-side diameter of the lid (100) of the outer inside surface of the transition layer (140) between the top of the orientation securing layer (150) and the bottom of the secure engagement layer (130) inhibits further downwards movement of the lid (100) relative to the cup (200). Similarly, the narrowing of the side-to-side diameter at the transition between the orientation securing layer (150) and the guidance skirt (160) inhibits upwards movement of the lid (100) relative to the cup (200).

Figure 7A:
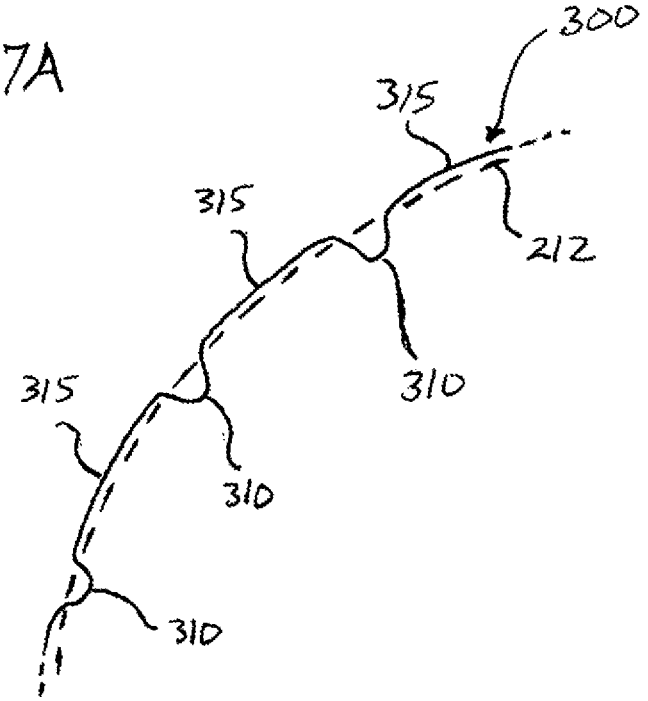
FIG. 7A shows a top down, close-up, schematic cross-sectional view of the outer edge of the cup rim and the inside contour of a lid with detented overhangs when no lid-removing force is applied.
Figure 7B:
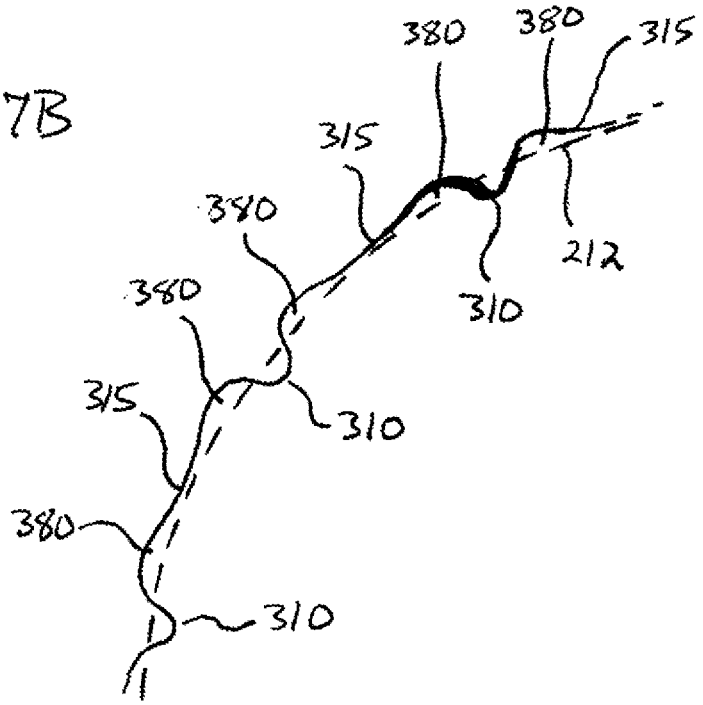
FIG. 7B shows a top down, close-up, schematic cross-sectional view of the outer edge of the cup rim and the inside contour of a lid with detented overhangs when a lid-removing force is applied.

It is important to note that according to the present invention the rim portion (120), including the transition overhang layer (140), has cylindrical symmetry. This is to be contrasted with many common cup lids where what would be the equivalent of the cylindrically-symmetric overhang layer (140) of the cup lid (100) of the present invention has an n-fold symmetry with n overhanging detents (where n is a large number), but does not have cylindrical symmetry. For instance, (i) the large and medium size lids used by Burger King of Miami, Florida, (ii) the lids for 9 ounce SOLO cups manufactured by Dart Container of Mason Michigan, (iii) domed cold-drink lids used by Starbucks of Seattle, Washington, and (iv) medium cup lids used by McDonalds of Chicago, Illinois have "detented overhangs" and hence do not have cylindrical symmetry. It should be noted that a detented overhang layer cannot function as well in preventing leakage as a cylindrically-symmetric (i.e., non-detented) overhang, and therefore the present invention is directed to a cup lid with a cylindrically-symmetric overhang layer. In particular, detented overhangs are vulnerable to leakage in the regions between the detents. This vulnerability to leakage is due to the facts that (i) there is often a lower amount of contact force between a detented lid and the cup in regions between the detents, and (ii) the contact force between the lid and the cup in regions between the detents is further lowered, possibly even reduced to zero, and possibly there are even gaps created between the lid and the cup when a lid-removal force is applied to the lid. FIGS. 7A and 7B provide top down, close-up, schematic cross-sectional views of the outer edge (212, depicted as a dashed line) of the cup rim (210) and the inside contour of a lid (300) with detented overhangs (310). As shown in FIG. 7A, when the detented-overhangs lid (300) is mounted on the cup with no lid-removing force applied to the lid (300), the inter-detent regions (315) are in contact with the outer edge (212) of the cup rim (210) and the detents (310) extend inwards beyond the outer edge (212) of the cup (200). (However, for clarity of depiction the inter-detent regions (315) are shown as displaced by a short distance from the outer edge (212) of the cup rim (210).) It should be noted that the inter-detent regions (315) are concave inwards when no lid-removing force is applied. However, as shown in FIG. 7B, when a lid-removing force is applied to the lid (300), the detents (310) are forced outwards (relative to their positions in FIG. 7A) and the inter-detent regions (315) are contorted, possibly even to an extent where the inter-detent regions (315) are no longer completely concave inwards. Thus, lowered contact pressure and possibly even gaps (380) between the lid (300) and the cup (200) may be created. Such gaps (380) allow leakage even when the lid (300) is still engaged with the cup (200). Therefore, since an object of the present invention is to provide a lid which prevents leakage, the rim portion (120), and particularly the transition overhang layer (140), has cylindrical symmetry.

Figure 3A:
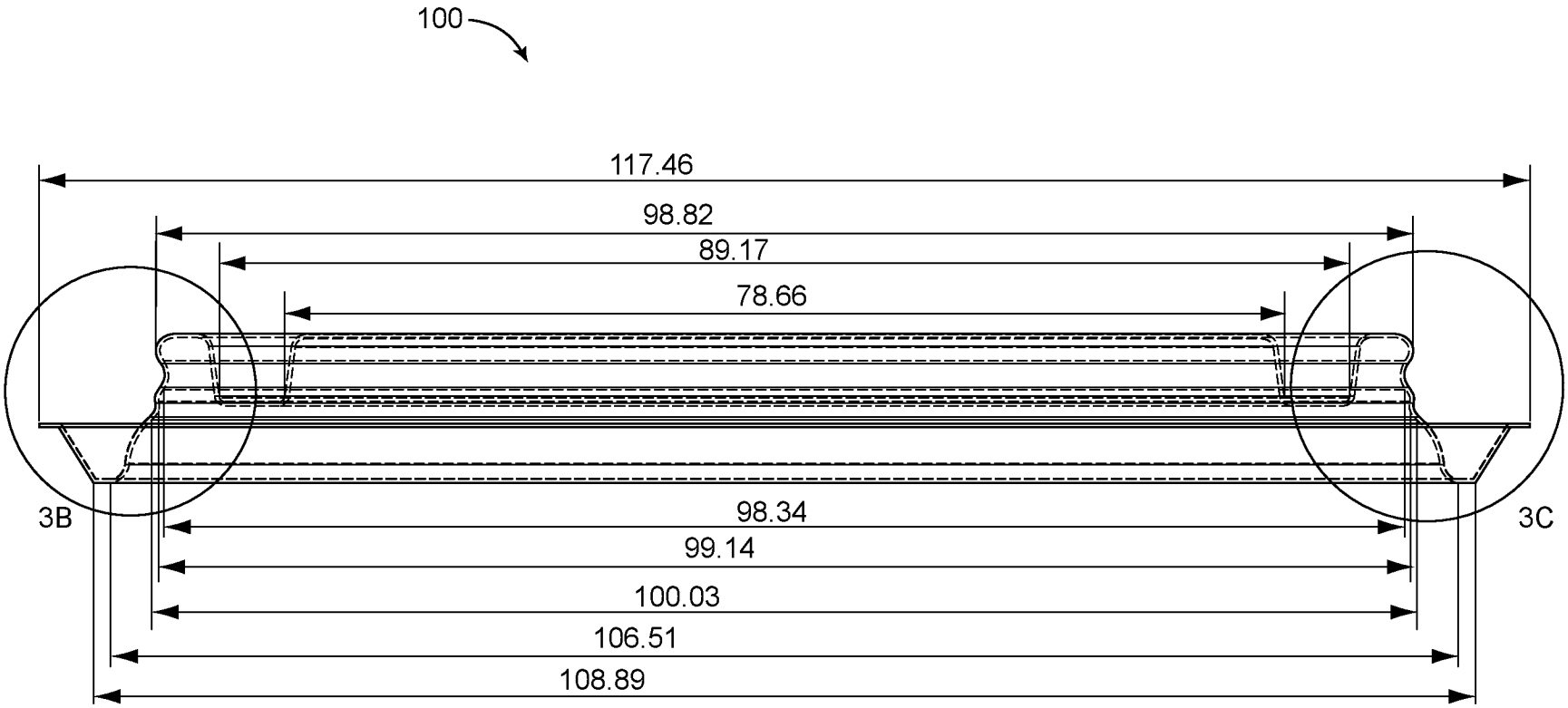
FIGS. 3A, 3B and 3C provide dimensions of a first embodiment of the securely-attaching removable lid of the present invention for use with 18-ounce red plastic, "square bottom," "party" cups manufactured by SOLO Cup Company of Lake Forest, Illinois, which is a subsidiary of Dart Container Corporaton of Mason, MI.
Figure 3C:
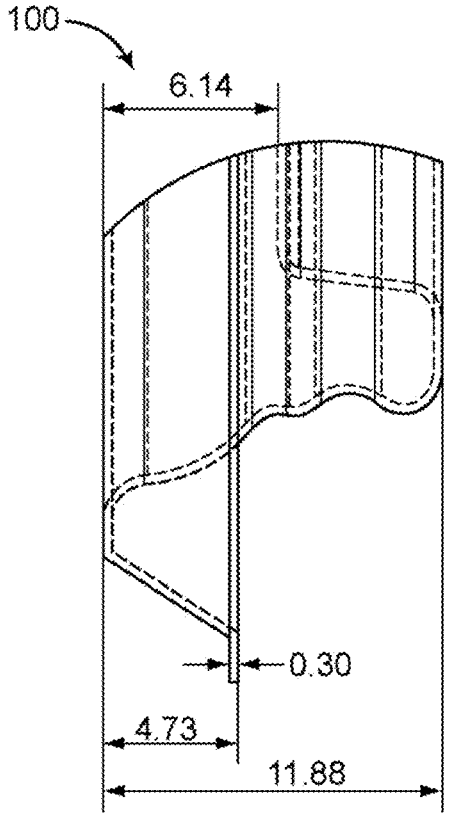

Based on the depth of the cylindrically-symmetric overhang (which from FIG. 3A can be seen to be 99.14–98.34=0.80 mm for this embodiment which is particularly designed to be a lid for 18-ounce red plastic, "square bottom," "party" cups manufactured by SOLO Cup Company of Lake Forest, Illinois), the thickness of the material (which from FIG. 3C can be seen to be 0.30 mm), the flexibility of the material (which is dependent on the tensile strength and flexural modulus), and the dimensions and contours of the secure engagement layer (130), transition overhang layer (140), and orientation securing layer (150), the force $F_O$ required to navigate the cup rim (210) into the orientation securing layer (150) from an initial position at the top of the guidance skirt (160) is:

(i) less than a force $F_{x\text{-}c}$ which would cause the cup (200) to crumple, or a force $F_{x\text{-}1}$ which would cause the lid (100) to crumple, and (ii) less than a force $F_S$ which would cause the cup rim (210) to continue into the secure engagement layer (130).

(It should be noted that the above-specified forces $F_O$, $F_{x\text{-}c}$, $F_{x\text{-}1}$, and $F_S$ are forces which are applied uniformly along the outer circumference of the cup (200) or the lid (100).)

The maximum weight W of a beverage in the above-specified SOLO cup is roughly 510 grams, i.e., the weight provided by the formula W=mg, where m is mass and g is the acceleration due to gravity, of 18 ounces of water since it can be assumed that the specific gravity of the beverage is roughly that of water. The force $F_S$ which retains the cup rim (210) in the secure engagement layer (130) is preferably greater than $W/_2$ (which is, for instance, roughly the force on the lid (100) when a lidded cup (200) full of beverage in the upright orientation is rotated 90° to a horizontal orientation), more preferably greater than W (which is, for instance, the force on the lid (100) when a lidded cup (200) full of beverage in the upright orientation is rotated 180° to an upside-down orientation), more preferably greater than 2W (which is, for instance, the force on the lid (100) when a lidded cup (200) substantially full of beverage is shaken with moderate force), more preferably greater than 3W (which is the force on the lid (100) when a lidded cup (200) substantially full of beverage is shaken with somewhat vigorous force), and still more preferably roughly equal to or greater than 4W (which is the force on the lid (100) when a lidded cup (200) substantially full of beverage is shaken with somewhat more vigorous force). It should be noted that the above-discussed forces applied by the beverage are forces which are applied uniformly along the interior portion (110) of the lid (100).

A tightness-of-fit multiple φ for a particular cup and lid is defined as the force f required to remove the lid divided by the weight W of the nominal amount of water which the cup is designed to hold, where the force f is applied at an edge of the lid (100) and the weight W is equal to the mass m of the water times the acceleration due to gravity g of 980 $cm/s^2$, i.e, $$\Phi = f/m\,g.$$

(It should be noted that according to the notation used in the present application, a lowercase letter f is used for a force applied at the edge of the lid, and an uppercase letter F is used for a force applied uniformly across the lid.) Table 1 provided in FIG. 4 lists the tightness-of-fit multiple φ for the lid (100) of the present invention and a variety of commonly found cups and lids. It should be noted that the forces f listed in Table 1 are in grams and are not technically forces, but forces divided by the quantity g. As can be seen from Table 1, none of the prior art lids have a tightness-of-fit multiple φ greater than 2.6. Hence, the present invention teaches a tightness-of-fit multiple φ which is greater than the greatest value listed in the table of FIG. 4 for the prior art lids. According to the present invention, the tightness-of-fit multiple φ is greater than 2.8, more preferably greater than 3.0, and still more preferably greater than 3.2, and still more preferably greater than 3.4.

Figure 2D:
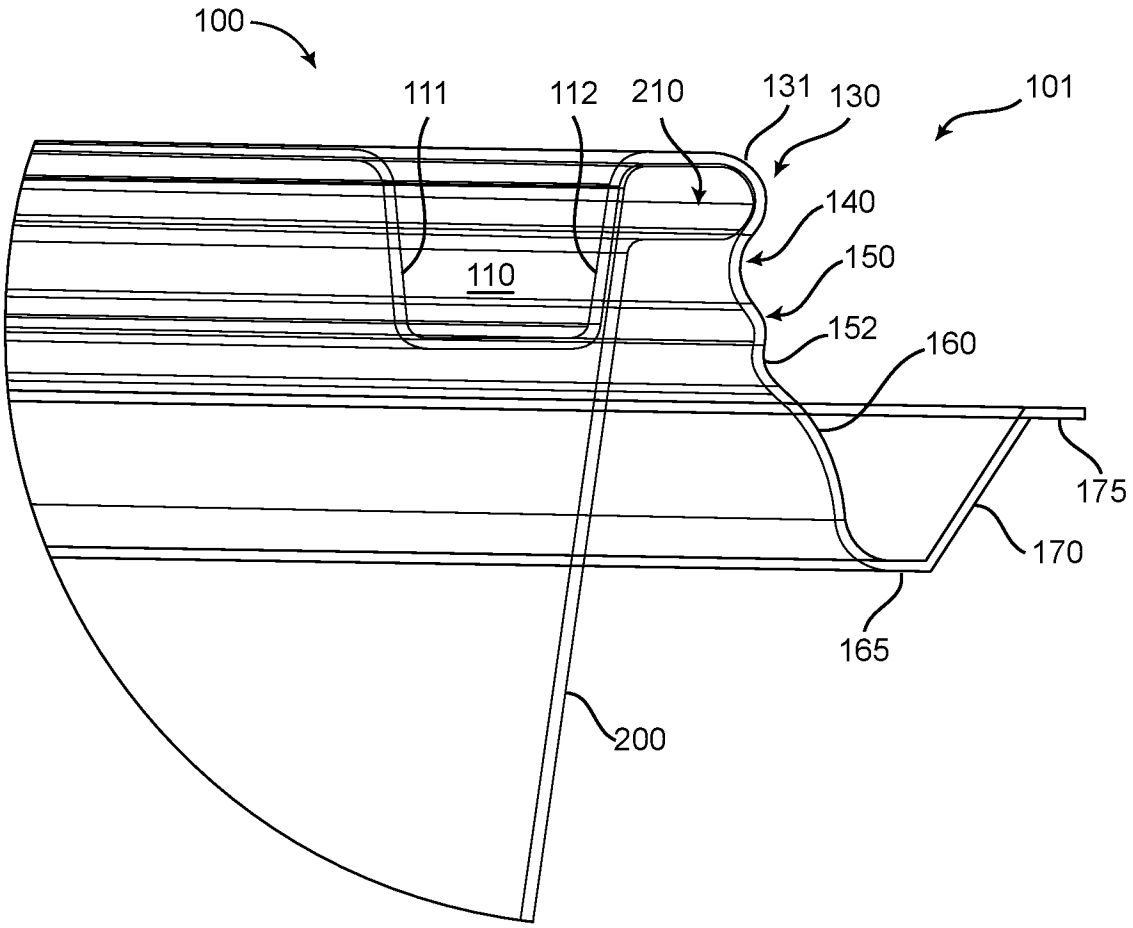
FIG. 2D is a magnified cross-sectional view showing the engagement of the rim of the cup in the secure engagement layer of the lid of FIG. 1 with the force limiting wing in the slanted upwards orientation.
Figure 5A:
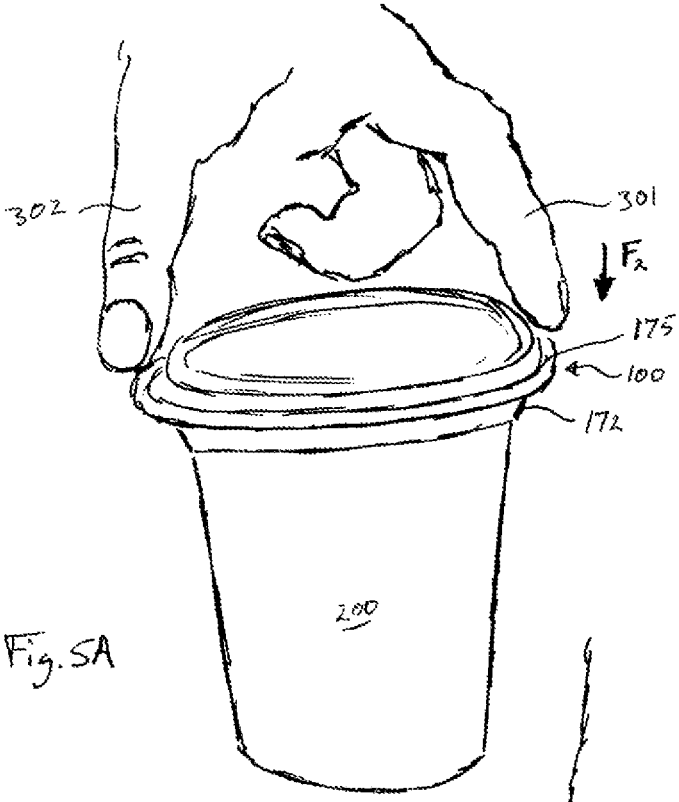
FIGS. 5A and SB show the flipping from an upwards slanting orientation to a downwards slanting orientation of the force limiting wing during the transitioning of the cup rim into the secure engagement layer.
Figure 5B:
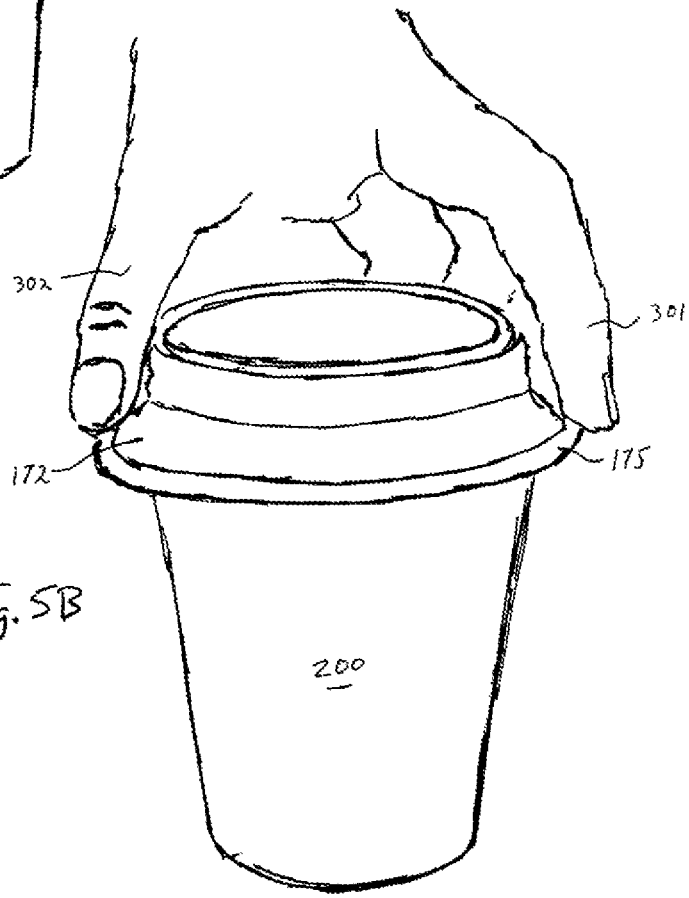

Once the cup rim (210) is engaged in the orientation securing layer (150) as shown in FIG. 2C, downwards force $F_S$ applied to the lid (100) will cause the outside portion of the lid (100) outwards from at the top outside corner (131) of the secure engagement layer (130) to temporarily flex/pivot outwards to allow the cup rim (210) to pass through the transition layer (140) and become securely engaged in the secure engagement layer (130), as is shown in FIG. 2D. (It should be noted that, as discussed below, the force limiting wing (170) may be flipped to a downwards orientation as shown in FIG. 5B during the process of securely engaging the cup rim (210) in the secure engagement layer (130). Once the cup rim (210) is engaged in the secure engagement layer (130), the force limiting wing (170) may be flipped back to an upwards orientation as shown in FIGS. 2D and SA.) As can be seen from FIG. 2D, the outer edge of the cup rim (210) fits snugly in the inner surface of the secure engagement layer (130) with the inner face of the cup rim (210) abutting the inside inner surface of the secure engagement layer (130). Because it is an object of the invention to have a secure enough engagement to provide spill resistance and allow for vigorous agitation, the required force $F_S$—which is related to, but not necessarily equal to, the force required to dislodge the cup rim (210) from the secure engagement layer (130) when the force is applied at the edge of the lid—is larger than forces needed in standard disposable plastic lid/cup engagements. (It should be noted that, as discussed in more detail below, according to a preferred embodiment of the present invention, the force required to dislodge the cup rim (210) from the secure engagement layer (130) by agitation of the contents of the cup (100) is greater than the force required to manually dislodge the lid by lifting an edge of the lid.) This force $F_S$ begins to approach the magnitude of forces $F_{x\text{-}c}$ and $F_{x\text{-}1}$ which might produce crumpling of the cup (200) or lid (100).

Figure 3B:
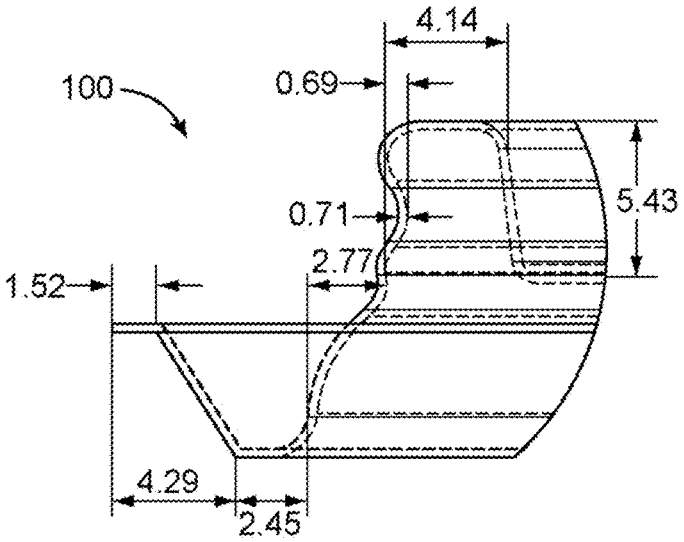

The orientation securing layer (150) inhibits pivoting of the orientation of the lid (100) as the cup rim (210) is transitioned into engagement with the secure engagement layer (130), and the force limiting wing (170) limits the amount of force that can be applied. Once the cup rim (210) is engaged in the orientation securing layer (150), a finger (301) and the thumb (302) can be placed on opposite sides of the horizontal outer flange (175), as is shown in FIG. 5A, and by pushing down the cup rim (210) is (i) navigated from engagement in the orientation securing layer (150) to engagement in the secure engagement layer (130), and (ii) the force limiting wing (170) may be flipped from an upwards orientation, as is shown in FIGS. 1, 2A-2D and 5A, to a downwards orientation, as is shown in FIG. 5B. The dimensions of the force limiting wing (170) (which can be determined by inspection FIGS. 3A, 3B and 3C), the thickness of the material of the force limiting wing (170) (which from FIG. 3C can be seen to be 0.30 mm), the flexibility of the material (which is dependent on the tensile strength and flexural modulus), and the dimensions and contours the transition overhang layer (140) and the secure engagement layer (130) are such that:

(i) the force $F_S$ required to navigate the cup rim (210) from the orientation securing layer (150) is less than a force $F_W$ which causes the force limiting wing (170) to flip into a downwards orientation; and (ii) the force $F_W$ which causes the force limiting wing (170) to flip into a downwards orientation is less than a force $F_{x-c}$ that which would cause the cup (200) to crumple or a force $F_{x-1}$ that which would cause the lid (100) to crumple.

It should be noted that the preferred embodiment of the lid (100) shown in the figures and described in detail above is designed particularly for 18-ounce red disposable plastic "square bottom," "party" cups manufactured by SOLO Cup Company of Lake Forest, Illinois, and so the particulars of dimensions and material properties of the lid (100) are suited and optimized for use with this type of disposable cup. However, the principles associated with this embodiment (100) can be generalized to provide securely-attaching removable lids for cups of other shapes (including other lip shapes made with or without a lip-rolling machine or similar apparatus), types, materials (such as natural, fiber, one-use, recycled, recyclable, plastic or non-plastic material, etc.), etc., such as other types of cups made by SOLO Cup Company or its competitors or any other cup or lid manufacturing company.

Figure 6A:
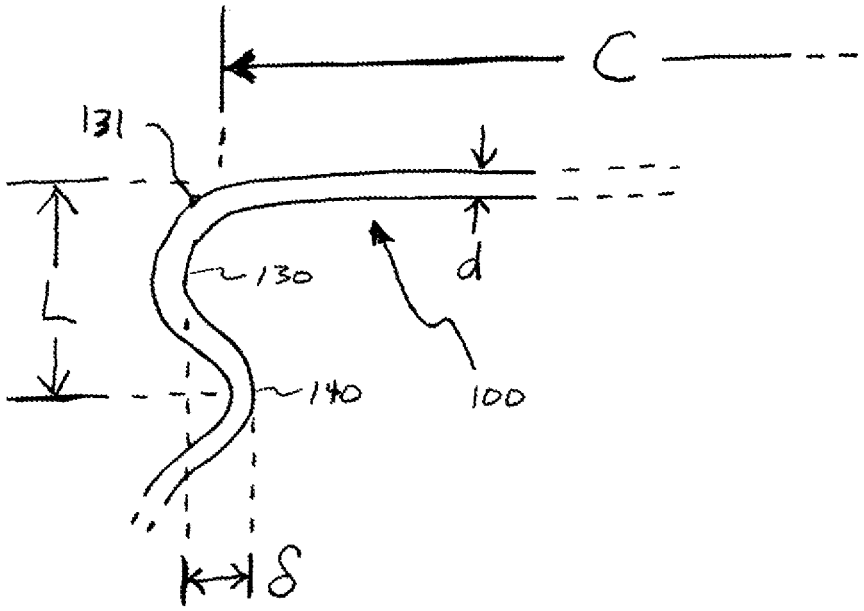
FIG. 6A shows a close-up cross-sectional view of the edge of the lid with labeled dimensions.
Figure 6B:
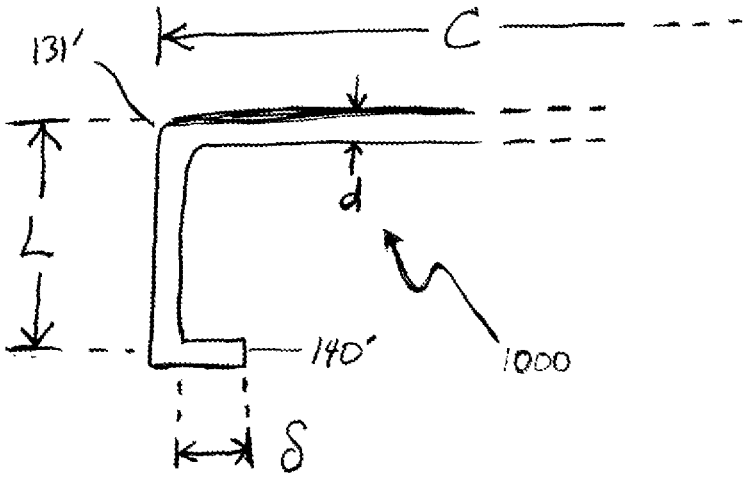
FIG. 6B shows a geometrically simplified version of the close-up cross-sectional view of the edge of the lid of FIG. 6A which can be used for quantitative explication and dimensionless analysis of the engagement/release force $F_R$ according to the present invention.

For the purpose of quantitative explication and dimensionless analysis of the engagement/release force $F_S$ according to the present invention, the geometry of an edge of the lid (100) which is shown in close-up in FIG. 6A with labeled dimensions is approximated by the geometry (1000) shown in FIG. 6B. In FIG. 6A, the lid (100) has a thickness d, the center of the transition overhang layer (140) is located a distance L from the top outside corner (131) of the lid (100)/(1000), the transition overhang layer (140) has a depth of δ and (not shown in FIG. 6A) the top outside corner (131) of the lid (100)/(1000) has a circumference C. In the simplified geometry shown in FIG. 6B, the lid (100') has a thickness d, the center of the transition overhang layer (140') is located a distance L from the top outside corner (131') of the lid (100'), the transition overhang layer (140') has a depth of δ, and (not shown in FIG. 6B) the top outside corner (131') of the lid (100') has a circumference C. Under the further approximation that the position of the top outside corner (131') is fixed and using the well-known beam deflection equation, the release force $F_R$ needed to pivot the transition overhang layer (140') outwards by a distance δ is roughly given by $$F_R \approx 3\,\delta\, E\, I/L^3.$$

where E is the Young's modulus of the material of the lid (100'), and I is the moment of inertia about the centroid of the region between the top outside corner (131') and the transition overhang layer (140'). Given that the region between the top outside corner (131') and the transition overhang layer (140') is approximated as a rectangular beam with thickness d and a width equal to the circumference C of the top outside edge (131') of the lid (100'), the moment of inertia I about the centroid is given by $C\,d^3/12$. Substituting this expression for the moment of inertia I into the equation above provides $$F_R \approx \delta\, E\, d^3\, C/4L^3$$

For example, for a preferred embodiment of the present invention made of Pentafood Rigid APET FD-E630F01 plastic (which has a Young's modulus E of approximately $2\times10^5$ N/mm$^2$, i.e., $2\times10^{12}$ dynes/cm$^2$) which is designed for use with a 18 ounce SOLO cup which has a top circumference of C=31 cm, a depth δ of the overhang is 0.07 cm, a thickness d of 0.03 cm, and a length L of 0.33 cm, then $F_S=8\times10^8$ dynes. The magnitude of the release force $F_R$ is large and it should be noted that the value of the release force $F_R$ is representative of and roughly proportional to the force required to remove the lid, but the release force $F_R$ is not of the same magnitude as the force required to remove the lid. This is because of the numerous approximations made to provide a readily calculable quantity. In addition to the approximation made concerning the shape of the lid (100) in the region below the outside corner (131), it is assumed that (i) the lid (100) comes off the cup (200) without tilting so that the region below the outside corner (131) distorts uniformly around the entire circumference of the lid (100), and (ii) that the lip (152) of the cup (200) does not compress at the same time as the region below the outside corner (131) of the lid (100) expands. Both these approximations lead to an overestimate of the release force $F_R$. For instance, it has been confirmed experimentally that the force required to remove the lid (100) without tilting is much greater than the force required to remove the lid by applying a force at one edge, i.e., with tilting.

According to the present invention, a tightness-of-fit dimensionless ratio Ψ is defined as $$\Psi = \delta\, E\, d^3\, C/4m\, g\, L^3$$

where m is the mass of liquid that can be contained in the cup (200), and g is acceleration due to gravity, i.e, 980 cm/s$^2$. For instance, for a preferred embodiment of the present invention made of Pentafood Rigid APET FD-E630F01 plastic (which has a Young's modulus E of approximately $2\times10^5$ N/mm$^2$, i.e., $2\times10^{12}$ dynes/cm$^2$) which is designed for use with a 18 ounce SOLO cup which holds a mass of 510 grams of a beverage, has a top circumference of C=31 cm, a depth δ of the overhang is 0.07 cm, a thickness d of 0.03 cm, and a pivot length L of 0.33 cm, the value of the tightness-of-fit dimensionless ratio Ψ is roughly 1600.

Table 1 provided in FIG. 4 lists tightness-of-fit ratios Ψ as well as the values of the variables used to generate the tightness-of-fit ratios Ψ for a number of common disposable cup lids. As can be seen from the table, none of the lids have a tightness-of-fit ratio Ψ greater than 140. Hence, the present invention teaches a tightness-of-fit ratio Ψ which is greater than the greatest value listed in Table 1. According to a preferred embodiment of the present invention Ψ>200, still more preferably Ψ>300, still more preferably Ψ>500, still more preferably Ψ>800, and still more preferably Ψ>1400, and still more preferably Ψ>1600. As Ψ increases further a sealed cup may be more and more vigorously shaken, or even tossed, without the lid (100) coming off.

It may be noted that for the lid (100) of the present invention the tightness-of-fit ratio Ψ provided in Table 1 is considerably greater than the tightness-of-fit multiple φ provided in Table 1. As discussed above, this difference is due to the locations of the applied forces. The calculation of the tightness-of-fit ratio Ψ assumes that the entire circumference of the lid (100) between top outer edge (131) and the overhang (140) expands, and this corresponds to a force which is uniformly applied across the bottom inside portion (110) of the lid (100). In contrast, calculation of the tightness-of-fit multiple φ is based on a force which is applied at an edge of the lid (100). Application of a force at an edge of the lid (100) can allow that edge to be lifted off by only expanding the lid (100) between top outer edge (131) and the overhang (140) in the region near where the force is applied, and therefore less force is required.

It should be noted that removable lids for disposable cups is an old and crowded field of art. Lids for disposable cups have been made of many materials with a variety of different dimensions, and many different lid designs have been developed to provide a wide variety of functionalities and appearances. The prevalence of lids with detented overhangs, which as discussed above are vulnerable to leakage, as a means for attachment is an indication that the object of the invention of providing a leak-proof disposable cup lid with the above-described performance capabilities is believed to be an indication of unobvious. It should also be considered a significant indicator of unobviousness of the present invention that other disposable cup lids have a dimensionless tightness-of-fit ratio Ψ and a tightness-of-fit multiple φ which are considerably different from the tightness-of-fit ratio Ψ and a tightness-of-fit multiple φ of the lid of the present invention. It should also be noted that secure attachment of this magnitude is essentially taught against because ease of use is a primary consideration when designing disposable cup lids since one of the primary advantages of disposability is ease of use. A lid which requires significantly more force to dislodge than commonly-found lids would, by traditional criteria, be considered to be difficult to use. Therefore, designing a cup lid which requires a relatively large amount of force to remove would be considered antithetical to the design goals for a disposable cup lid because the objects and advantages of the cup lid of the present invention have been previously unappreciated. (That being said, it should be understood that, as discussed above, the cup lid of the present invention is designed to be relatively easy to secure to and purposefully dislodge from a cup, while at the same time requiring a relatively large agitation- or tipping-induced force to dislodge the lid from the cup.)

Furthermore, according to the present invention the lid (100) has good flight properties when tossed as a flying disk because (i) the profile of cross-section of the lid (100) roughly approximates the shape of an airfoil, and (ii) there are multiple substantially vertical portions near the perimeter (101) of the lid (100) augment the moment of inertia. In particular, the outer surfaces of the secure engagement layer (130), the transition overhang layer (140), the orientation securing layer (150), and the force limiting wing (170) produce an outer surface that roughly simulates the curved front edge of an airfoil. With regards to the moment of inertia, the multiple substantially vertical surfaces near the perimeter (101) of the lid (100)—i.e., the inside and outside walls (111) and (112) of the trough (110), the skirt (160), and the upwards slanting portion (172) of the force limiting wing (170), as well as the outside surfaces of the secure engagement layer (130), the transition overhang layer (140), and the orientation securing layer (150)—function to augment the weight at the outer edge (131) of the lid (100), and this increases the moment of inertia of the lid (100) about the axis of cylindrical symmetry (199). The augmented moment of inertia and the approximate airfoil shape of the lid (100) allow the lid (100) be tossed like a flying disk with good flight characteristics.

It is believed that incorporating a secondary use (i.e., flight) into the design of the securely-attachable, removable lid of the present invention significantly increases its appeal. For instance, there is an attractive synergy produced in the fun of the invention since a lid (100) can be used to mix a party drink without concern for leakage or spilling from the ensemble being overturned, or a carrier of the cup being bumped or jostled, or the cup being used for the mixing of its contents by vigorous shaking, and then once the lid (100) is removed a game aspect is incorporated into the occasion where users attempt to fly their lid into a garbage can or at a target.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable those skilled in the art to best utilize the invention and the various elements of the embodiments, alone or in any combination, with various modifications as are suited to the particular use contemplated. Many other variations are possible. For example: the cup need not be plastic; the lid need not be plastic; the cup may more generally be a container of any sort; the lid need not have a force limiting wing; the lid need not have an orientation securing layer so, for instance, the guidance skirt may lead directly into the transition overhand layer; there may be a sequence of guidance skirts leading to the orientation securing layer or the secure engagement layer; the lid need not have an orientation securing layer and a guidance skirt; the cup and/or lid need not be disposable; the lid may be designed for another type of cup and therefore have different dimensions; the lid may be composed of another type of material; the lid may include a straw hole or aperture, or a drinking spout; etc.

Furthermore, the description of the physical principles underlying the operation and performance of the present invention are also presented for purposes of illustration and description, and are not intended to be exhaustive or limiting. It should be understood that these descriptions include approximations, simplifications and assumptions to present the basic concepts in a tractable form, and some effects which influence the operation and performance are neglected for ease of presentation. For example: the material need not have an unvarying thickness; any of the layers may have a different contour; the secure attachment overhang need not have cylindrical symmetry; the forces may be applied in more complex ways than specified, e.g., a force nominally applied at the edge of the lid may include components at other locations along the lid, or a force nominally applied uniformly across the entire inner portion of the lid or nominally applied uniformly over the entire circumference of the lid may not be uniformly applied; etc.

Accordingly, it is intended that the scope of the invention be determined not by the embodiments illustrated or the physical analyses motivating the illustrated embodiments, but rather by Claims and their legal equivalents appended to a non-provisional patent application based on this provisional patent application.

What is claimed is:

1. A securely-engaging removable lid for a cup having a cup rim, comprising:

a central portion;

a secure engagement layer at the periphery of said central portion for secure engagement with said cup rim when said cup rim is seated in an interior concave contour of said secure engagement layer, and when unflexed an inside contour of said secure engagement layer having an overhang having cylindrical symmetry, said overhang protruding towards the axis of said cylindrical symmetry, and a dimensionless tightness-of-fit ratio Ψ being defined as $$\Psi=\delta\, E\, d^3\, C/4\, m\, g\, L^3$$

where m is a mass of liquid that can be contained in said cup, g is acceleration due to gravity of 980 cm/s$^2$, E is a Young's modulus of the material of said securely engaging removable lid, C is a circumference of said secure engagement layer, δ is a depth of said overhang, d is a thickness of the material in said overhang layer, and L is a length from a top outside edge of said secure engagement layer to a central point of said overhang, the value of said dimensionless tightness-of-fit ratio Ψ being greater than 1400.

2. The securely-engaging removable lid of claim 1 wherein said dimensionless tightness-of-fit ratio Ψ has a value greater than 1600.

3. A securely-engaging removable lid for a cup having a cup rim and having a capacity of holding m grams of a beverage, comprising:

a central portion;

a secure engagement layer at the periphery of said central portion for secure engagement with said cup rim when said cup rim is seated in an interior contour of said secure engagement layer, and when unflexed an inside contour of said secure engagement layer having an overhang having cylindrical symmetry, said overhang protruding towards the axis of said cylindrical symmetry and being a distance below a top inside edge of said secure engagement layer so as to be adapted to engage with a lower edge of said cup rim, said overhang having a placement and size such that a dimensionless tightness-of-fit multiple ϕ defined as a force f applied at an edge of the lid required to remove the lid from said cup divided by said mass m times acceleration due to gravity g of 980 cm/s$^2$ is greater than 2.8.

4. The securely-engaging removable lid of claim 3 wherein said dimensionless tightness-of-fit multiple ϕ has a value greater than 3.0.

5. The securely-engaging removable lid of claim 3 wherein said dimensionless tightness-of-fit multiple ϕ has a value greater than 3.2.

6. The securely-engaging removable lid of claim 3 wherein said dimensionless tightness-of-fit multiple ϕ has a value greater than 3.4.

7. A securely-engaging removable lid for a cup having a cup rim, comprising:

a central portion;

a secure engagement layer at the periphery of said central portion for secure engagement with said cup rim when said cup rim is seated in an interior concave contour of said secure engagement layer; and an orientation securing layer adjoining said secure engagement layer for stabilizing an orientation of the lid relative to said cup rim during a first transition of said cup rim from a first position where said cup rim is in contact with said orientation securing layer to a second position where said cup rim is in contact with said secure engagement layer, said cup rim being seatable in said orientation securing layer with an outer edge of said cup rim fitting snugly in an inner concave contour of said orientation securing layer.

8. The securely-engaging removable lid of claim 7 further including a guidance skirt adjoining said orientation securing layer for providing guidance of said cup rim during a second transition of said cup rim from a third position where said cup rim is in contact with said guidance skirt to said first position where said cup rim is in contact with said orientation securing layer.

9. The securely-engaging removable lid of claim 7 further including a force limiting wing extending from a bottom edge of said guidance skirt, said force limiting wing having a default upwards slanting orientation, and a portion of said force limiting wing being flippable into a downwards slanting orientation, said cup rim having an exterior cup rim diameter and said force limiting wing having a first inner diameter when in said upwards slanting orientation and a having a second inner diameter when in said downwards slanting orientation, said first inner diameter being greater than said exterior cup diameter and said second inner diameter being greater than said exterior cup diameter.

10. The securely-engaging removable lid of claim 7 wherein said first transition of said cup rim from said orientation securing layer into said secure engagement layer requires a force $F_S$ ; and said second transition of said cup rim from said guidance skirt into said orientation securing layer requiring a force $F_O$, where $F_S>F_O$, where $F_S$ is less than a force $F_{X\text{-}L}$ which causes crumpling of said cup, where $F_S$ is less than a force $F_{X\text{-}L}$ which causes crumpling of the lid, and where $F_S>W$ where W is the weight of a beverage having a specific gravity of unity in said cup when said cup is full of said beverage.

11. The securely-engaging removable lid of claim 9 wherein said first transition of said cup rim from said orientation securing layer into said secure engagement layer requires a force $F_S$; and said second transition of said cup rim from said guidance skirt into said orientation securing layer requiring a force $F_O$, where $F_S>F_O$, where $F_S$ is less than a force $F_{X\text{-}C}$ which causes crumpling of said cup, where $F_S$ is less than a force $F_{X\text{-}L}$ which causes crumpling of the lid, where $F_S>W$ where W is the weight of a beverage having a specific gravity of unity in said cup when said cup is full of said beverage, and where said portion of said force limiting wing is flippable from said upwards slanting orientation to said downwards slanting orientation with a force $F_W$ such that $F_W>F_S$, and $F_W<F_{X\text{-}L}$ and $F_W<F_{X\text{-}C}$.

* * * * *